US005904149A

United States Patent [19]

Ruhl et al.

[11] Patent Number: 5,904,149

[45] Date of Patent: May 18, 1999

[54] SUPPORT DEVICE FOR ARTIFICIAL FINGERNAILS

[76] Inventors: Florence J. Ruhl; Stephen L. Ruhl, both of 791 N. Saint Judes Dr., Longboat Key, Fla. 34228

[21] Appl. No.: 08/890,468

[22] Filed: Jul. 9, 1997

[51] Int. Cl.[6] ..... A45D 29/11

[52] U.S. Cl. ..... 132/73; 211/13.1; 269/43; 269/296

[58] Field of Search ..... 132/73, 73.5; 211/12, 211/13.1, 59.1, 32, 87.01, 33; 269/43, 296; 248/205.3; D28/61; 206/581, 823; 134/100, 89

[56] References Cited

U.S. PATENT DOCUMENTS

| | | | |
|---|---|---|---|
| D. 305,370 | 1/1990 | Williams | D28/61 |
| 2,007,636 | 7/1935 | Brothers | 211/87 |
| 2,017,538 | 10/1935 | Kaparin | 434/100 |
| 2,709,004 | 5/1955 | Dahlstrom | 211/33 |
| 3,485,344 | 12/1969 | Aylott . | |
| 3,578,158 | 5/1971 | Aylott | 206/581 |
| 4,696,316 | 9/1987 | Stanley . | |
| 5,482,057 | 1/1996 | Bushmaker . | |
| 5,570,793 | 11/1996 | Killough | 132/73 |
| 5,615,782 | 4/1997 | Choe | 211/87.01 |
| 5,669,515 | 9/1997 | Tisbo et al. | 211/87.01 |

*Primary Examiner*—Todd E. Manahan
*Assistant Examiner*—Eduardo C. Robert
*Attorney, Agent, or Firm*—Malin, Haley, DiMaggio & Crosby, PA

[57] ABSTRACT

A support device for artificial fingernails for selectively securing artificial fingernails on individual support members, which device includes an elongated base having a substantially planar bottom surface and a plurality of individual nail support members connected to the base and extending vertically therefrom. Each support member includes a top portion forming a nail support surface which includes a quantity of reusable tacky material incorporated thereon for securing an individual nail to the support surface. In the preferred embodiment, the base is sized for accommodating five, similarly sized, vertically extending nail support members in spaced relation aligned along the longitudinal axis of the base.

7 Claims, 3 Drawing Sheets

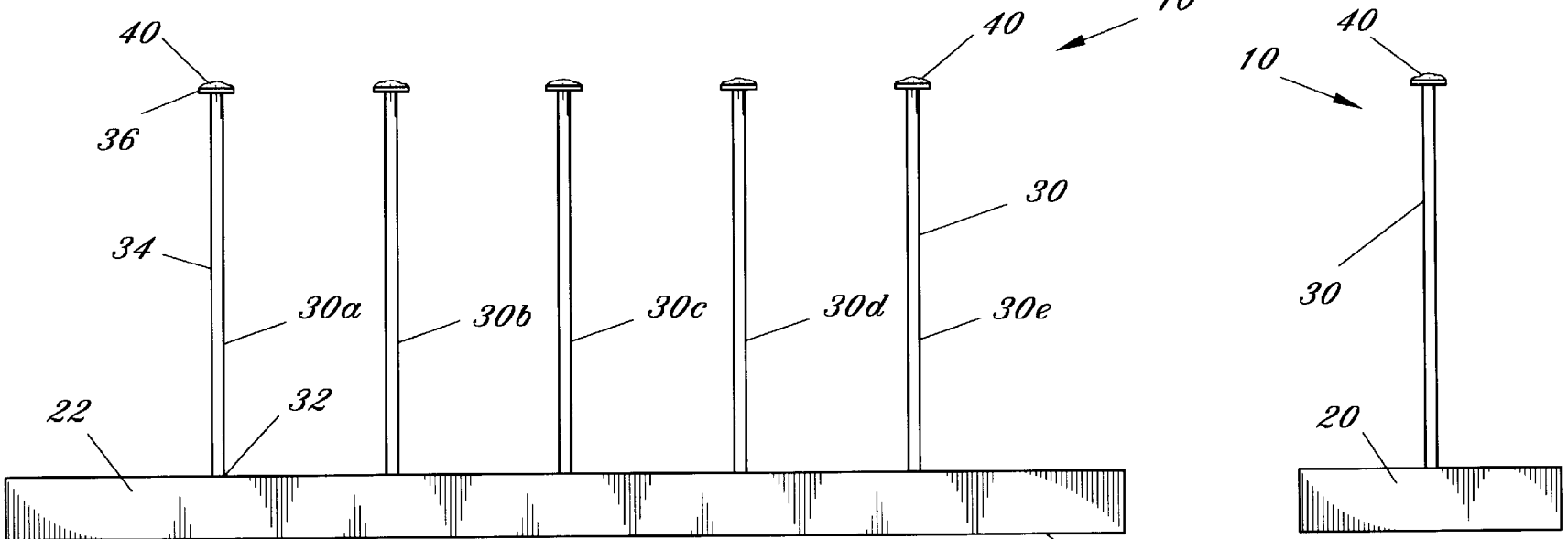
Fig. 1
Fig. 2
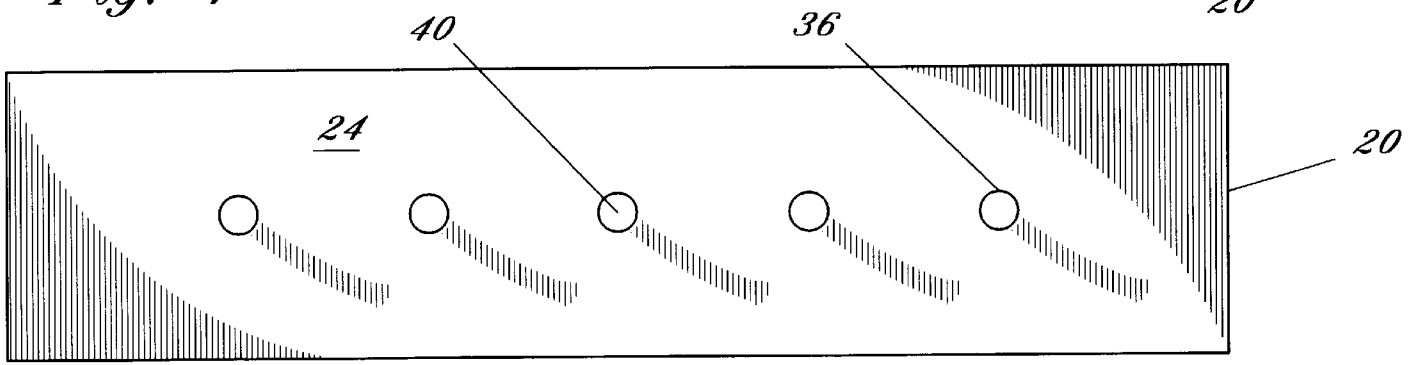
Fig. 3

SUPPORT DEVICE FOR ARTIFICIAL FINGERNAILS

BACKGROUND OF THE INVENTION

1. Field of the Invention

The present invention relates to devices for use with artificial fingernails, and more particularly, to a device for retaining artificial fingernails during polishing, drying, maintenance and storage.

2. Description of the Background Art

The use of artificial fingernails (hereinafter "artificial nails") among women and young ladies has gained widespread acceptance. Artificial nails comprise curved fingernail-like structures commonly formed from a synthetic or plastic material, and may be obtained from a wide variety of sources. The application of artificial nails includes adhesively securing each nail to a person's natural nail, allowing the adhesive to cure, and subsequently finishing the nails by trimming and polishing to obtain a natural appearance. In addition, extended length nails that extend significantly past the end of the wearer's finger tips are often used to give the appearance of natural long nails.

There are, however, a number of disadvantages associated with the polishing of artificial nails once attached to the human nails. Specifically, freshly polished nails must be allowed to dry and the drying time for each nail disables the user from any manual activity for several minutes while each nail drys. Therefore, if nail polish were applied to each nail and allowed to dry before the nail is physically attached to the wearer's natural nails, the wearer would not have to experience the disadvantages associated with the time required to allow the nail polish to dry.

Some of the disadvantages associated with artificial nails are addressed by disclosures in the background art. For example, U.S. Pat. No. 4,696,316, issued to Stanley, discloses a stand for polishing artificial fingernails, comprising a base having a convex head and a device for releasably attaching the fingernails to the head. U.S. Pat. No. 5,482,057, issued to Bushmaker, discloses a support for polishing artificial fingernails. The Bushmaker device is defined by a cylinder, having a first diameter forming a handle, a second diameter defining a surface having a curvature approximate that of an artificial thumbnail, and a third diameter defining a surface having a curvature approximate that of an artificial nail. U.S. Pat. No. 3,485,344, issued to Aylott, discloses a display device for artificial fingernails wherein artificial nails may be mounted for storage, transport and display purposes.

The background art, however, fails to disclose a device for effectively supporting artificial nails to provide adequate support during the application of polish while allowing the nails to be easily removed once dried.

SUMMARY OF THE INVENTION

A support device for artificial fingernails for selectively securing a plurality of artificial fingernails individually on individual support members for a variety of purposes. The device includes an elongated base having a substantially planar bottom surface and a plurality (e.g. 5 or 10) of individual nail support members connected to the base and extending vertically therefrom. Each support member includes a top portion forming a nail support surface which includes a quantity of reusable tacky material incorporated thereon for adhesively securing an individual nail to the support surface.

In the preferred embodiment, the base is sized for accommodating five, similarly sized, vertically extending nail support members in spaced relation aligned along the longitudinal axis of the base. In alternate embodiments, the elongated base may define an arcuate shape with the nail support members aligned along an arcuate axis of the base. Furthermore, in certain situations it may be desirable for the nail support members to be of varying lengths.

The present invention thus provides a support device for use in securing artificial fingernails. The support device of the present invention may be used for securing artificial nails for numerous purposes including use as a work platform for trimming, filing, and finishing artificial nails prior to applying the nails to the wearer's fingers. In addition, the support device of the present invention is suitable for use in storing or displaying artificial fingernails.

Artificial nails are easily secured to, and removed from, the device by placing each nail in contact with the tacky material existing on the support surface of one of said support members. The tacky material functions to adhesively secure the nails to the support members. Since the tacky material has a consistency similar to that of a pasty substance such as putty, the material provides a resilient support surface which allows for a certain amount of flexure or deflection of the nails which is desirable when applying liquid coatings with a brush and simulates the flexure present with fingers supporting natural nails.

Accordingly, it is an object of the present invention to provide a support device for artificial fingernails.

Yet another object of the present invention is to provide a support device for artificial nails which device includes a plurality of individual nail support members each including means for resiliently and selectively securing artificial nails thereto.

In accordance with these and other objects which will become apparent hereinafter, the instant invention will now be described with particular reference to the accompanying drawings.

BRIEF DESCRIPTION OF THE DRAWINGS

The present invention is further described in the drawings wherein:

FIG. 1 depicts a front elevational view of the preferred embodiment of the invention;

FIG. 2 depicts a side elevational view of the preferred embodiment of the present invention;

FIG. 3 depicts a top plan view of the preferred embodiment of the present invention;

DESCRIPTION OF THE PREFERRED EMBODIMENTS

Figure 4:
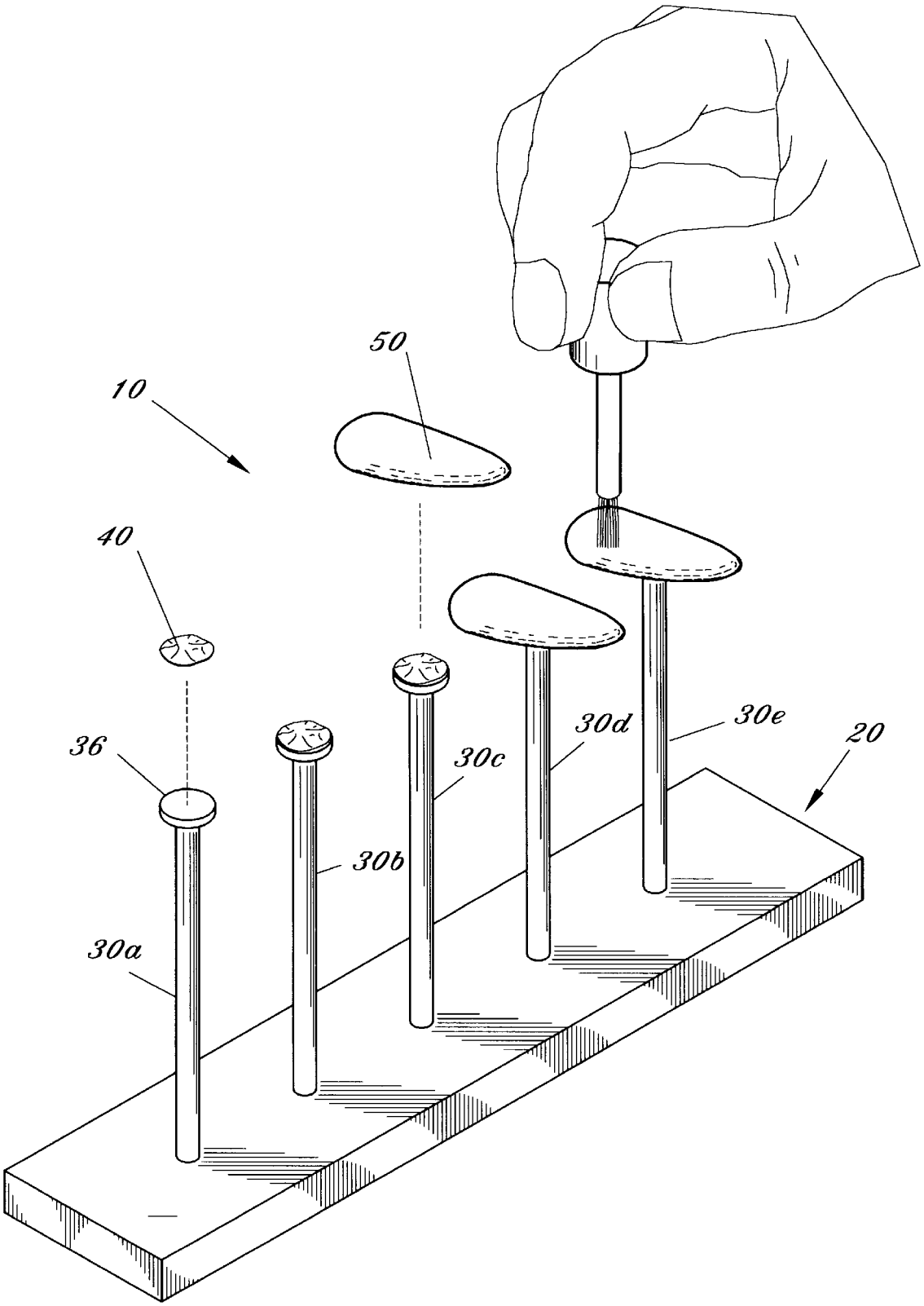
FIG. 4 depicts a perspective view of the preferred embodiment of the present invention.

With initial reference to FIGS. 1–3, there is depicted the preferred embodiment of the support device for artificial fingernails, generally referenced as 10. Support device 10 includes a base 20, support members 30, and tacky adhesive material 40. FIG. 4 depicts a perspective view of the support device 10 of the present invention.

Base 20 forms a stable foundational structure and includes a bottom portion defining a substantially planar bottom surface 22, for maintaining device 10 in a stable upright configuration, and a top portion 24. Base 20 may be formed from any suitable natural or synthetic material and may include decorative or stylized features to provide an aesthetically pleasing appearance. In the preferred embodiment, base 20 comprises an elongate, generally rectangular, structure having a length of approximately 6", a width of approximately 1", and a height of approximately ½", however, any suitable dimensions are considered within the scope of the invention.

A plurality of support members, referenced 30*a–e*, are connected to base 20, in substantial alignment, as best depicted in FIGS. 1 and 2. Each support member 30 includes: a bottom portion 32 connected to base 20; a substantially rigid, vertically extending body portion 34; and, a top portion forming a nail support surface 36. Support members 30 are fabricated from any suitable rigid material and are sized to extend approximately 2"–3" above the top portion of base 20, as best depicted in FIGS. 1 and 2. As previously described, each support member top portion defines a substantially horizontal and generally planar support surface 36. In alternate, embodiments, however, it may be desirable for the planar support surfaces to have an orientation that is other than horizontal, such that the surfaces may exist at an angle. As best seen in FIG. 3, support surfaces 36 are generally circular, however, any suitable shape is considered within the scope of the invention.

Each support surface 36 includes a quantity of tacky material 40 thereon for facilitating the adhesive securing of artificial nails thereto. In the preferred embodiment, tacky material 40 comprises a reusable material having a putty-like consistency, and is characterized as having a quality that prevents portions of the tacky material 40 from sticking to the undersurface of the artificial nails placed in contact therewith. As is apparent, an artificial nail placed in contact with tacky material 40 will remain resiliently affixed on support surface 36.

As is now apparent, artificial nails, referenced as 50 in FIG. 4, may be removably affixed to support members 30 by placing the undersurface of each nail in contact with the tacky material existing on support surfaces 36. Once affixed, the nails 50 are maintained in a convenient position for the user, whereby the user is easily able to apply nail polish and the like directly to the nails thereby facilitating the preparation of the nails prior to being worn. In addition, the freshly polished nails may be left affixed to surfaces 36 until dry, thereby allowing the user to attend to other affairs.

Figure 5:
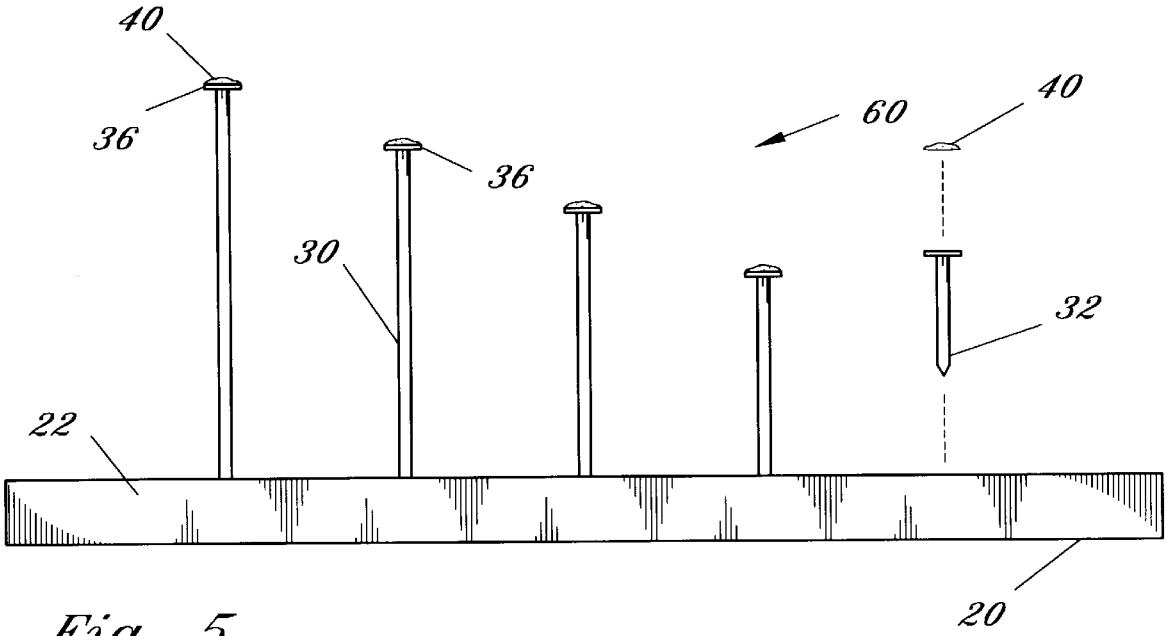
FIG. 5 depicts a side elevational view of an alternate embodiment.
Figure 6:
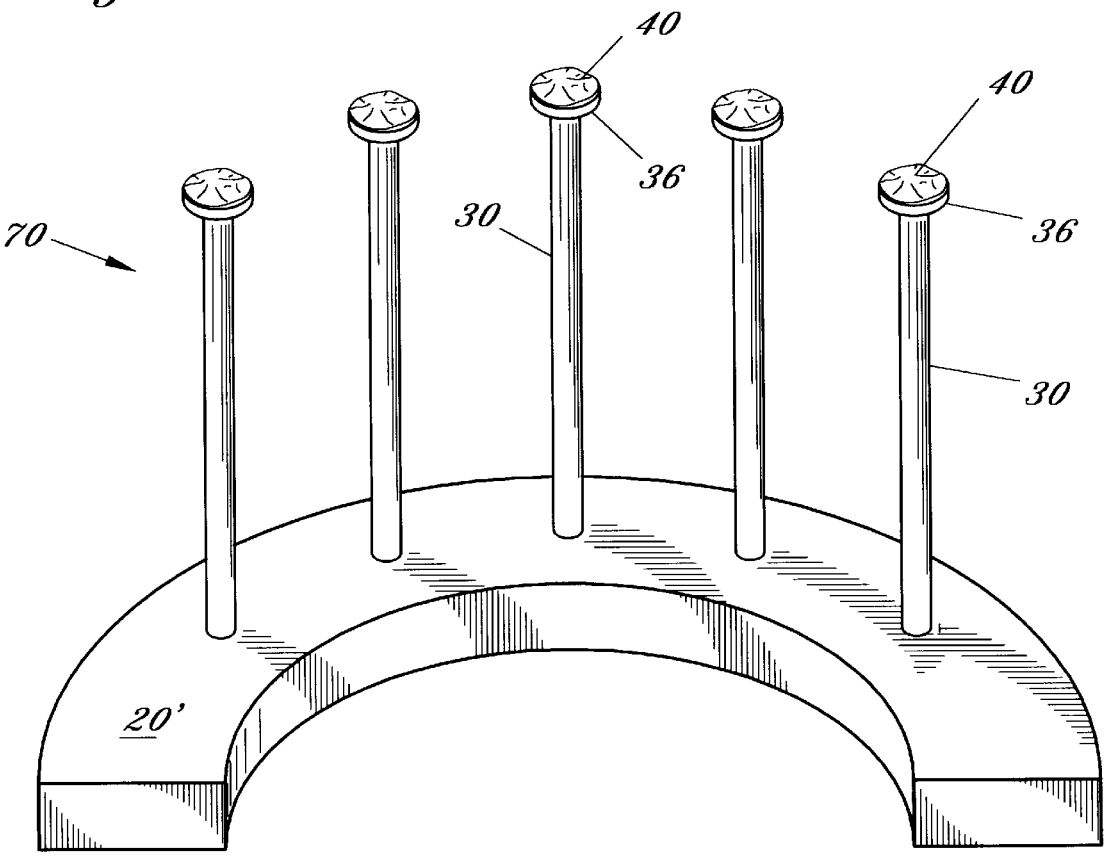
FIG. 6 depicts a front perspective view of another alternate embodiment.

FIGS. 5 and 6 depict alternate embodiments of the present invention. As depicted in FIG. 5, a first alternate embodiment, generally referenced as 60, includes support members 30 of varying lengths thus terminating at different heights. As depicted in FIG. 6, a second alternate embodiment, generally referenced as 70, includes an arcuate base 20'.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A support device and a plurality of artificial fingernails for retaining artificial fingernails during preparation, polishing, drying or storing the artificial fingernails, said support device comprising:

an elongated base;

at least one artificial nail support member connected to said base, said support member including a top portion defining a support surface, said support surface including means for flexibly retaining an artificial fingernail thereon such that the artificial fingernail retained on said support surface is allowed to flex in response to the application of liquid coatings with the brush;

said means for flexibly retaining includes tacky material having putty-like consistency.

2. A support device for retaining artificial fingernails during preparation, polishing, drying, or storing the artificial fingernails, said support device comprising:

an elongated base having a longitudinal axis;

a plurality of artificial nail support members connected to said base and extending vertically therefrom, each of said support members including a top portion defining a generally circular support surface;

each circular support surface having a quantity of tacky material thereon;

said tacky material having putty-like consistency for flexibly supporting an artificial nail, whereby artificial fingernails mounted on said tacky material are flexibly retained thereon.

3. A support device for retaining artificial fingernails according to claim 2, wherein said plurality of support members are aligned along said longitudinal axis.

4. A support device for retaining artificial fingernails according to claim 2, wherein said longitudinal axis is substantially linear.

5. A support device for retaining artificial fingernails according to claim 2, wherein said longitudinal axis is arcuate.

6. A support device for retaining artificial fingernails according to claim 2, wherein each of said support members are of equal length.

7. A support device for retaining artificial fingernails according to claim 2, wherein said support members are of unequal length.

* * * * *